US010234143B2

(12) United States Patent
Cadima

(10) Patent No.: US 10,234,143 B2
(45) Date of Patent: Mar. 19, 2019

(54) METHOD FOR OPERATING A FORCED ASPIRATION GAS COOKING APPLIANCE

(71) Applicant: General Electric Company, Schenectady, NY (US)

(72) Inventor: Paul Bryan Cadima, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 1134 days.

(21) Appl. No.: 14/533,155

(22) Filed: Nov. 5, 2014

(65) Prior Publication Data

US 2016/0123599 A1 May 5, 2016

(51) Int. Cl.
*F23N 1/02* (2006.01)
*F24C 3/12* (2006.01)

(52) U.S. Cl.
CPC ..... *F24C 3/126* (2013.01)

(58) Field of Classification Search
CPC ..... F23N 1/002; F23N 1/022; F23N 2033/08; F23N 2035/16; F24C 3/126
USPC ..... 99/331; 431/12; 126/21 A
See application file for complete search history.

(56) References Cited

U.S. PATENT DOCUMENTS 4,645,450 A * 2/1987 West ..... F23N 1/022 431/12
5,971,745 A * 10/1999 Bassett ..... F23N 1/022 431/12
9,557,059 B2 * 1/2017 Kucera ..... F23N 1/002
2003/0109938 A1 * 6/2003 Daum ..... H04L 12/2803 700/11
2005/0221243 A1 * 10/2005 Najewicz ..... F23D 14/04 431/18
2008/0143550 A1 * 6/2008 Ebrom ..... G06F 9/54 340/12.29
2010/0112500 A1 * 5/2010 Maiello ..... F23N 1/022 431/76
2011/0266473 A1 * 11/2011 Santinanavat ..... F23N 1/002 251/30.01
2013/0149651 A1 * 6/2013 Thielvoldt ..... F24B 1/181 431/12
2013/0153798 A1 * 6/2013 Kucera ..... F23N 1/002 251/129.01
2013/0220301 A1 * 8/2013 Saksena ..... A47J 27/16 126/377.1
2014/0316586 A1 * 10/2014 Boesveld ..... H04Q 9/00 700/278
2015/0300660 A1 * 10/2015 Kim ..... F24H 9/2035 237/8 A

FOREIGN PATENT DOCUMENTS

JP 4713520 B2 6/2011

* cited by examiner

*Primary Examiner* — Dana Ross
*Assistant Examiner* — Lawrence H Samuels
(74) *Attorney, Agent, or Firm* — Dority & Manning, P.A.

(57) ABSTRACT

A method for operating a forced aspiration gas cooking appliance is provided. The method includes connecting the forced aspiration gas cooking appliance to a network and establishing a location of the forced aspiration gas cooking appliance based at least in part on a location characteristic of the network. An altitude of the forced aspiration gas cooking appliance is determined based at least in part on the location of the forced aspiration gas cooking appliance.

20 Claims, 4 Drawing Sheets

METHOD FOR OPERATING A FORCED ASPIRATION GAS COOKING APPLIANCE

FIELD OF THE INVENTION

The present subject matter relates generally to forced aspiration gas cooking appliances.

BACKGROUND OF THE INVENTION

Cooking appliances with gas burners provide a flow of air and gaseous fuel to the gas burners during operation. The flow of air and gaseous fuel is generally mixed prior to combustion of the gaseous fuel in order to improve performance of the gas burner. In certain normally aspirated cooking appliances, pressure differences between a flow of gaseous fuel and a flow of air within a Venturi nozzle facilitate mixing of the flow of gaseous fuel and the flow of air. However, such normal mixing can limit performance of the cooking appliances.

To provide improved performance relative to normally aspirated cooking appliances, certain forced aspiration cooking appliances include a fan or air handler that mechanically introduces air for combustion. The fan can also improve mixing of the air and gaseous fuel at a gas burner of the forced aspiration cooking appliances. However, forced aspiration cooking appliances can be sensitive to altitude. For example, at higher altitudes, operating the fan at a speed calibrated to sea-level can provide an inadequate flow of air from the fan due to the decrease in air density as altitude increases. Thus, forced aspiration cooking appliances are generally calibrated such that a speed of forced aspiration cooking appliances' fans corresponds to an altitude of the forced aspiration cooking appliances. However, such calibrations can be tedious and may require expensive and difficult to maintain pressure sensors.

Accordingly, a method for operating a forced aspiration gas cooking appliance at various altitudes would be useful. In particular, a method for operating a forced aspiration gas cooking appliance at various altitudes that adjusts a speed of a fan of the forced aspiration gas cooking appliance based upon the altitude of the forced aspiration gas cooking appliance would be useful.

BRIEF DESCRIPTION OF THE INVENTION

The present subject matter provides a method for operating a forced aspiration gas cooking appliance. The method includes connecting the forced aspiration gas cooking appliance to a network and establishing a location of the forced aspiration gas cooking appliance based at least in part on a location characteristic of the network. An altitude of the forced aspiration gas cooking appliance is determined based at least in part on the location of the forced aspiration gas cooking appliance. Additional aspects and advantages of the invention will be set forth in part in the following description, or may be apparent from the description, or may be learned through practice of the invention.

In a first exemplary embodiment, a method for operating a forced aspiration gas cooking appliance is provided. The method includes connecting the forced aspiration gas cooking appliance to a network, establishing a location of the forced aspiration gas cooking appliance based at least in part on a location characteristic of the network, determining an altitude of the forced aspiration gas cooking appliance based at least in part on the location of the forced aspiration gas cooking appliance from said step of establishing, and adjusting a speed of an air handler of the forced aspiration gas cooking appliance based at least in part on the altitude of the forced aspiration gas cooking appliance from said step of determining.

In a second exemplary embodiment, a forced aspiration gas cooking appliance is provided. The forced aspiration gas cooking appliance includes a gas burner, an air handler configured for selectively urging a flow of air to the gas burner and a network interface. A controller is in operative communication with the air handler and the network interface. The controller is configured for connecting to a network with the network interface, establishing a location of the forced aspiration gas cooking appliance based at least in part on a location characteristic of the network, determining an altitude of the forced aspiration gas cooking appliance based at least in part on the location of the forced aspiration gas cooking appliance, and adjusting a speed of the air handler based at least in part on the altitude of the forced aspiration gas cooking appliance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
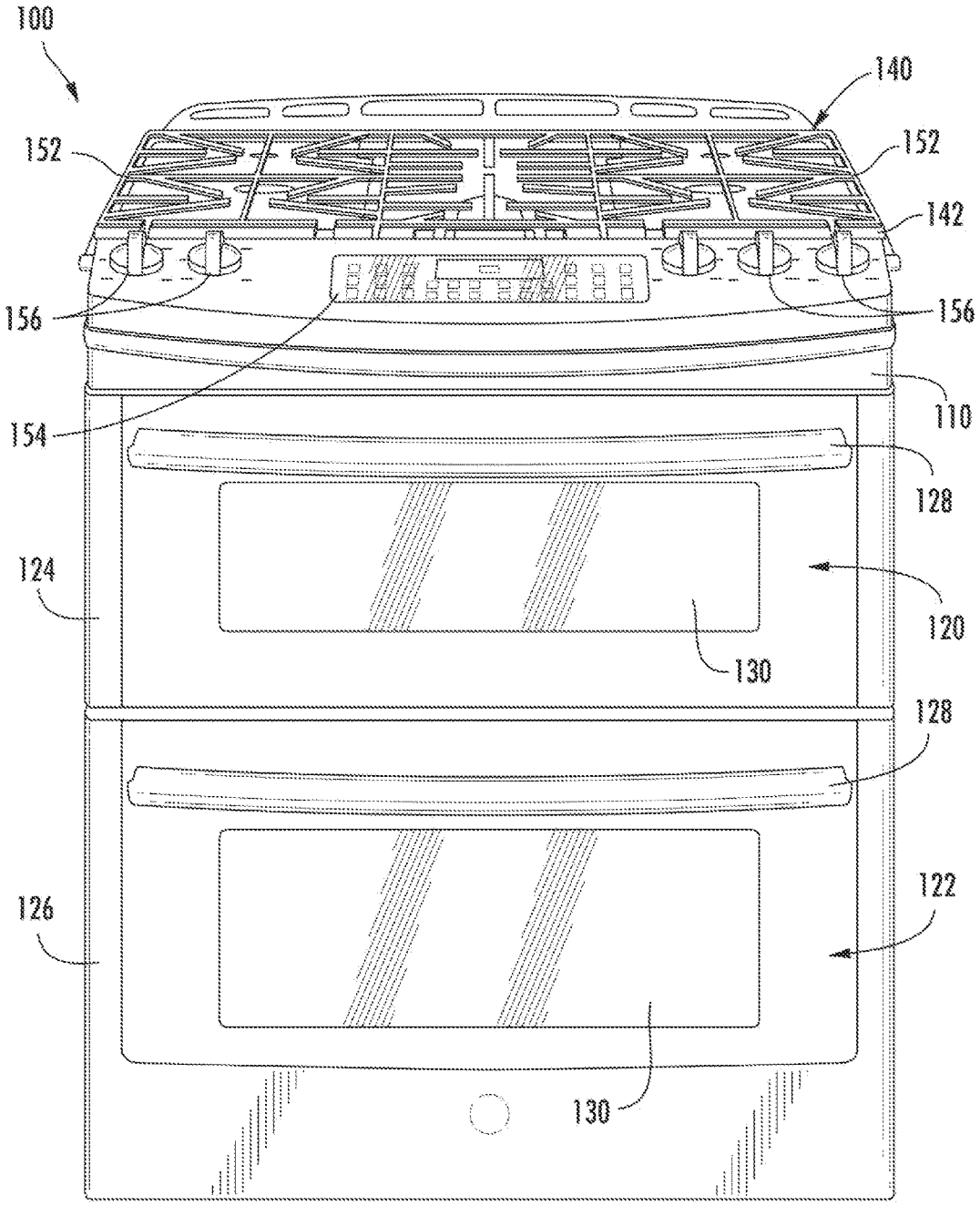
FIG. 1 provides a front, perspective view of a forced aspiration gas range appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
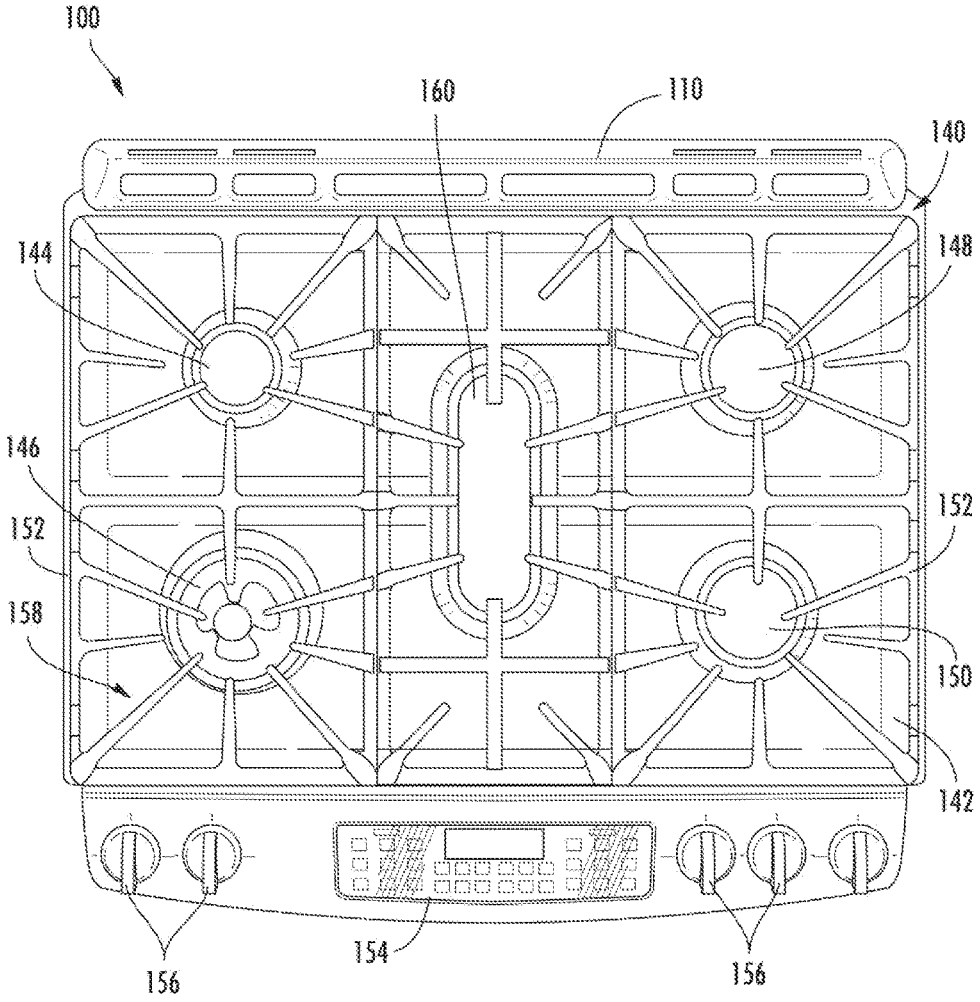
FIG. 2 provides a top, plan view of the exemplary forced aspiration gas range appliance of FIG. 1 and a burner assembly of the exemplary forced aspiration gas range appliance.

FIG. 1 provides a front, perspective view of a forced aspiration gas range appliance 100 as may be employed with the present subject matter. FIG. 2 provides a top, plan view of range appliance 100. Range appliance 100 includes an insulated cabinet 110. Cabinet 110 defines an upper cooking chamber 120 and a lower cooking chamber 122. Thus, range appliance 100 is generally referred to as a double oven range appliance. As will be understood by those skilled in the art, range appliance 100 is provided by way of example only, and the present subject matter may be used in any suitable appliance, e.g., a single oven range appliance or a standalone cooktop appliance. Thus, the exemplary embodiment shown in FIG. 1 is not intended to limit the present subject matter to any particular cooking chamber configuration or arrangement.

Upper and lower cooking chambers 120 and 122 are configured for the receipt of one or more food items to be cooked. Range appliance 100 includes an upper door 124 and a lower door 126 rotatably attached to cabinet 110 in order to permit selective access to upper cooking chamber 120 and lower cooking chamber 122, respectively. Handles 128 are mounted to upper and lower doors 124 and 126 to assist a user with opening and closing doors 124 and 126 in order to access cooking chambers 120 and 122. As an example, a user can pull on handle 128 mounted to upper door 124 to open or close upper door 124 and access upper cooking chamber 120. Glass window panes 130 provide for viewing the contents of upper and lower cooking chambers 120 and 122 when doors 124 and 126 are closed and also assist with insulating upper and lower cooking chambers 120 and 122. Heating elements (not shown), such as electric resistance heating elements, gas burners, microwave heating elements, halogen heating elements, or suitable combinations thereof, are positioned within upper cooking chamber 120 and lower cooking chamber 122 for heating upper cooking chamber 120 and lower cooking chamber 122.

Range appliance 100 also includes a cooktop 140. Cooktop 140 is positioned at or adjacent a top portion of cabinet 110. Thus, cooktop 140 is positioned above upper and lower cooking chambers 120 and 122. Cooktop 140 includes a top panel 142. By way of example, top panel 142 may be constructed of glass, ceramics, enameled steel, and combinations thereof.

For range appliance 100, a utensil holding food and/or cooking liquids (e.g., oil, water, etc.) may be placed onto grates 152 at a location of any of burner assemblies 144, 146, 148, 150. Burner assemblies 144, 146, 148, 150 provide thermal energy to cooking utensils on grates 152. As shown in FIG. 1, burners assemblies 144, 146, 148, 150 can be configured in various sizes so as to provide e.g., for the receipt of cooking utensils (i.e., pots, pans, etc.) of various sizes and configurations and to provide different heat inputs for such cooking utensils. Grates 152 are supported on a top surface 158 of top panel 142. Range appliance 100 also includes a griddle burner 160 positioned at a middle portion of top panel 142, as may be seen in FIG. 2. A griddle may be positioned on grates 152 and heated with griddle burner 160.

A user interface panel 154 is located within convenient reach of a user of the range appliance 100. For this exemplary embodiment, user interface panel 154 includes knobs 156 that are each associated with one of burner assemblies 144, 146, 148, 150 and griddle burner 160. Knobs 156 allow the user to activate each burner assembly and determine the amount of heat input provided by each burner assembly 144, 146, 148, 150 and griddle burner 160 to a cooking utensil located thereon. User interface panel 154 may also be provided with one or more graphical display devices that deliver certain information to the user such as e.g., whether a particular burner assembly is activated and/or the rate at which the burner assembly is set.

Although shown with knobs 156, it should be understood that knobs 156 and the configuration of range appliance 100 shown in FIG. 1 is provided by way of example only. More specifically, user interface panel 154 may include various input components, such as one or more of a variety of touch-type controls, electrical, mechanical or electro-mechanical input devices including rotary dials, push buttons, and touch pads. The user interface panel 154 may include other display components, such as a digital or analog display device designed to provide operational feedback to a user.

Figure 3:
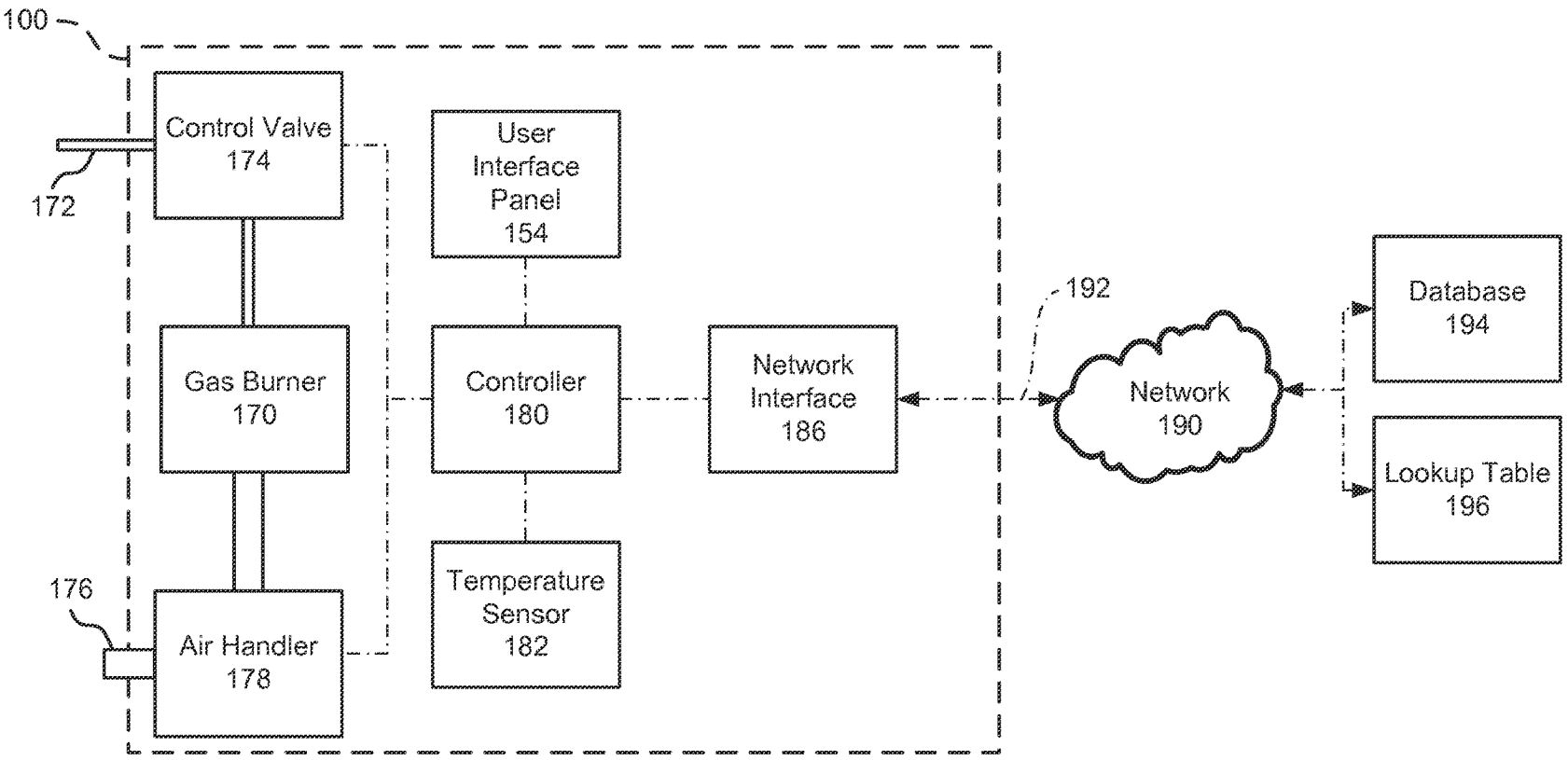
FIG. 3 provides a schematic view of certain components of the exemplary forced aspiration gas range appliance of FIG. 1.

FIG. 3 provides a schematic view of certain components of forced aspiration gas range appliance 100. A gas burner 170 of range appliance 100 may be any gas burner of range appliance 100. For example, gas burner 170 may be one of burner assemblies 144, 146, 148, 150, griddle burner 160, and the heating elements within upper and lower cooking chambers 120 and 122. A separate pilot light may be provided to ignite gaseous fuel and air as it exits a gas burner 170 of range appliance 100.

Gaseous fuel, such as natural gas or propane, is selectively supplied to gas burner 170, e.g., by a gaseous fuel supply line 172 that is coupled to an external fuel source. A control valve 174 is coupled to gaseous fuel supply line 172. Control valve 174 may regulate a flow of gaseous fuel through gaseous fuel supply line 172 to gas burner 170. For example, control valve 174 hinders or obstructs the flow of gaseous fuel to gas burner 170 via gaseous fuel supply line 172 when closed, and control valve 174 permits the flow of gaseous fuel to gas burner 170 via gaseous fuel supply line 172 when open. Other constructions and configurations of the gas fuel heating system, as are well known in the art, are contemplated by the present disclosure as well. Control valve 174 may be coupled to one of knobs 156 in order to permit a user to adjust control valve 174.

Range appliance 100 also includes an air conduit 176 that directs a flow of air to or towards gas burner 170. Gaseous fuel from gaseous fuel supply line 172 and air from air conduit 176 may enter and mix within gas burner 170, e.g., prior to combustion at an exit of gas burner 170. To assist such mixing, range appliance 100 includes an air handler 178. Air handler 178 is selectively operable to urge a flow of air through air conduit 176 to gas burner 170. The flow of air from air handler 178 mixes with the flow of gaseous fuel from gaseous fuel supply line 172 in order to improve performance of gas burner 170. Thus, range appliance 100 is generally referred to as a "forced aspiration gas range appliance" or a "fan assisted gas range appliance."

As may be seen in FIG. 3, range appliance 100 includes a controller 180 and a network interface 186. Controller 180 includes one or more processors and a memory, and provides appliance functionality. The processor(s) of controller 180 may be any suitable processing device, such as a microprocessor, microcontroller, integrated circuit, or other suitable processing device. The memory of controller 180 may include any suitable computing system or media, including, but not limited to, non-transitory computer-readable media, RAM, ROM, hard drives, flash drives, or other memory devices. The memory of controller 180 can store information accessible by processor(s) of controller 180, including instructions that can be executed by processor(s) of controller 180 in order to operate various components of range appliance 100 to provide appliance functionality. Controller 180 is in operative communication with various components of range appliance 100, including control valve 174, air handler 178, a temperature sensor 182, user interface panel 154 and network interface 186. Input/output ("I/O") signals may be routed between controller 180 and various operational components of range appliance 100 along wiring harnesses that may be routed through casing 110.

Temperature sensor 182 is configured for measuring a temperature of air within one of upper and lower cooking chambers 120 and 122. Temperature sensor 182 can be positioned at any suitable location within or on range appliance 100. For example, temperature sensor 182 may be positioned within one of upper and lower cooking chambers 120 and 122. Temperature sensor 182 can be any suitable temperature sensor. For example, temperature sensor 182 may be a thermocouple or a thermistor.

Network interface 186 may include any suitable components for interfacing with one more networks, such as network 190. For example, network interface 186 may include transmitters, receivers, ports, controllers, antennas, or other suitable components for interfacing with network 190. Network interface 186 may establish communication with network 190 via a connection 192. Connection 192 may be any suitable medium, e.g., wired or wireless.

Network 190 may be any type of communications network, such as a local area network (e.g. intranet), wide area network (e.g. Internet), or some combination thereof. In general, communication between controller 180 and network 190 may be carried via associated network interfaces using any type of connection, using a variety of communication protocols (e.g. TCP/IP, HTTP), encodings or formats (e.g. HTML, XML), and/or protection schemes (e.g. VPN, secure HTTP, SSL). In particular, the network 190 may be a wireless local area network (WLAN) configured to conform to IEEE 802.11.

Figure 4:
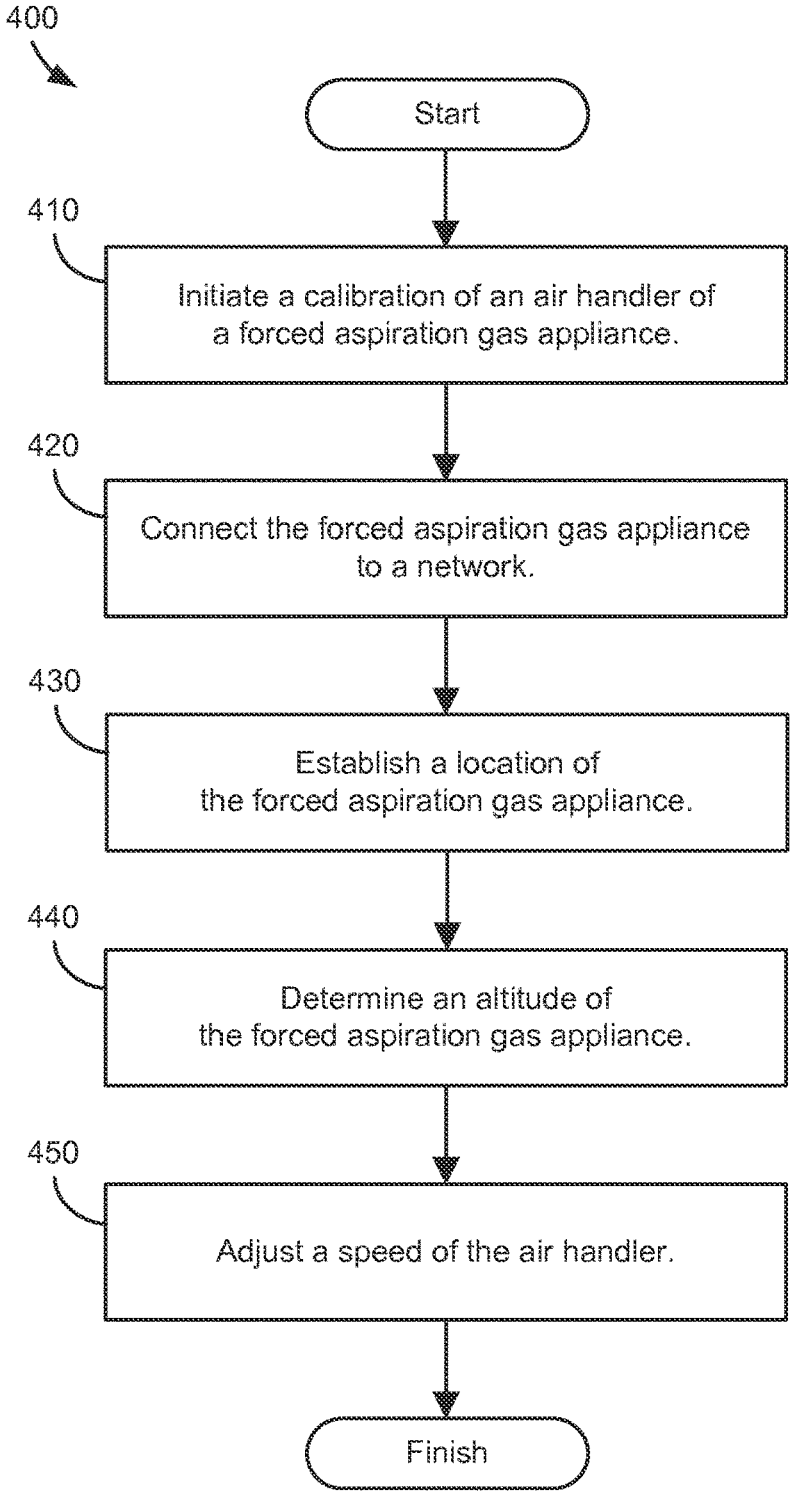
FIG. 4 illustrates a method for operating a forced aspiration gas cooking appliance according to an exemplary embodiment of the present subject matter.

FIG. 4 illustrates a method 400 for operating a forced aspiration gas cooking appliance according to an exemplary embodiment of the present subject matter. Method 400 may be used to operate any suitable forced aspiration gas cooking appliance. For example, method 400 may be used with range appliance 100 (FIG. 1). Thus, method 400 is discussed in greater detail below with reference to range appliance 100. However, it should be understood that method 400 is not limited to use in range appliance 100 or forced aspiration gas range appliances in general. For example, method 400 may be used with forced aspiration gas oven appliances, forced aspiration gas cooktop appliances, forced aspiration gas grills, etc., in alternative exemplary embodiments. Controller 180 may be programmed to implement various operations of method 400.

At step 410, a calibration of an air handler of a forced aspiration gas cooking appliance is initiated. As an example, a speed of air handler 178 of range appliance 100 may be calibrated in order to compensate for an altitude of range appliance 100, as discussed in greater detail below. At step 420, the forced aspiration gas cooking appliance is connected to a network. For example, network interface 186 of range appliance 100 may establish communication with network 190 via connection 192 at step 420. In particular, network interface 186 of range appliance 100 may establish communication with network 190 via a wireless network of a building in which range appliance 100 is located at step 420. During step 420, an Internet Protocol (IP) address may be assigned to the forced aspiration gas cooking appliance.

At step 430, a location of the forced aspiration gas cooking appliance is established, e.g., based at least in part on a location characteristic of the network to which the forced aspiration gas cooking appliance was connected at step 420. The location characteristic of the network may include at least one of an IP address, a service set identifier (SSID) and a media access control (MAC) address. As an example, the location of range appliance 100 may be established at step 430 based at least in part on the IP address of range appliance 100 assigned at step 420. In particular, a networked device, such as controller 180, may look up a location associated with the IP address of range appliance 100 in a database 194, e.g., at findmyip.org, arin.net, etc. Thus, controller 180 may query the database 194 via network 190 to establish the location of range appliance 100 at step 430. The database 194 may include a location for each IP address within the database. The database 194 may be crowd sourced or otherwise suitably compiled to establish the location associated with each IP address within the database 194.

At step 440, an altitude of the forced aspiration gas cooking appliance is determined, e.g., based at least in part on the location of the forced aspiration gas cooking appliance from step 430. As an example, a networked device, such as controller 180, may look up the altitude of range appliance 100 in a lookup table 196 having an altitude associated with the location of range appliance 100 from step 430. The lookup table 196 may have a respective altitude associated with each location in the lookup table 196. The lookup table 196 may be a GIS database, a USGS database, earthexplorer.usgs.gov, etc. Any other suitable method may be used to determine the altitude associated with the location from step 430. For example, the altitude may be interpolated or averaged from the altitudes of adjacent locations.

At step 450, the speed of the air handler of the forced aspiration gas cooking appliance is adjusted, e.g., based at least in part on the altitude of the forced aspiration gas cooking appliance from step 440. For example, controller 180 may increase the speed of air handler 178 if the altitude of range appliance 100 from step 440 is greater than a default altitude, or controller 180 may decrease the speed of air handler 178 if the altitude of range appliance 100 from step 440 is less than the default altitude. The default altitude may correspond to sea-level, and the speed of air handler 178 may be adjusted by a correction factor that corresponds to a difference in air density from sea-level to the altitude of the forced aspiration gas cooking appliance from step 440. In such a manner, method 400 may adjust the speed of the air handler of the forced aspiration gas cooking appliance, e.g., in order to calibrate the air handler and improve performance of a gas burner of the forced aspiration gas cooking appliance. In particular, method 400 may calibrate the air handler such that the air handler provides a suitable flow of air to the gas burner at various elevations.

Method 400 may also include steps for calibrating the air handler if steps 420, 430 and/or 440 fail to establish the elevation of the forced aspiration gas cooking appliance. For example, method 400 may include manually determining the location or altitude of range appliance 100 if the location of range appliance 100 is not established at step 430 or the altitude of range appliance 100 is not determined at step 440. For example, a user of range appliance 100 may manually enter the location or altitude of range appliance 100 on user interface 154, e.g., if range appliance 100 is not connected to network 190 at step 420, if the location of range appliance 100 is not established at step 430, and/or if the altitude of range appliance 100 is not determined at step 440.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a forced aspiration gas cooking appliance, comprising:

connecting the forced aspiration gas cooking appliance to a network;

establishing a location of the forced aspiration gas cooking appliance based at least in part on a location characteristic of the network;

determining an altitude of the forced aspiration gas cooking appliance based at least in part on the location of the forced aspiration gas cooking appliance from said step of establishing; and adjusting a speed of an air handler of the forced aspiration gas cooking appliance based at least in part on the altitude of the forced aspiration gas cooking appliance from said step of determining, wherein the location of the forced aspiration gas cooking appliance is a physical location of the forced aspiration gas cooking appliance.

2. The method of claim 1, wherein the location characteristic of the network comprises at least one of an Internet Protocol address, a service set identifier and a media access control address.

3. The method of claim 1, wherein said step of connecting comprises connecting the forced aspiration gas cooking appliance to wireless network of a building in which the forced aspiration gas cooking appliance is located.

4. The method of claim 1, wherein said step of connecting comprises assigning an Internet Protocol address to the forced aspiration gas cooking appliance.

5. The method of claim 4, wherein said step of establishing comprises establishing the location of the forced aspiration gas cooking appliance based at least in part on the Internet Protocol address of the forced aspiration gas cooking appliance.

6. The method of claim 5, wherein said step of establishing comprises looking up a location associated with the Internet Protocol address of the forced aspiration gas cooking appliance in a database.

7. The method of claim 1, wherein said of determining comprises looking up the altitude in a lookup table having a respective altitude associated with each location in the lookup table.

8. The method of claim 1, wherein said step of adjusting comprises increasing the speed of the air handler if the altitude of the forced aspiration gas cooking appliance from said step of determining is greater than a default altitude.

9. The method of claim 1, wherein said step of adjusting comprises decreasing the speed of the air handler if the altitude of the forced aspiration gas cooking appliance from said step of determining is less than a default altitude.

10. The method of claim 1, further comprising manually determining the location of the forced aspiration gas cooking appliance if the location of the forced aspiration gas cooking appliance is not established at said step of establishing or the altitude of the forced aspiration gas cooking appliance if the altitude of the forced aspiration gas cooking appliance is not determined at said step of determining.

11. The method of claim 10, wherein said step of manually determining comprises entering the location or the altitude of the forced aspiration gas cooking appliance on a user input of the forced aspiration gas cooking appliance.

12. The method of claim 1, wherein the forced aspiration gas cooking appliance is an oven appliance or a range appliance.

13. A forced aspiration gas cooking appliance, comprising:

a gas burner;

an air handler configured for selectively urging a flow of air to the gas burner;

a network interface; and a controller in operative communication with the air handler and the network interface, the controller configured for connecting to a network with the network interface;

establishing a location of the forced aspiration gas cooking appliance based at least in part on a location characteristic of the network;

determining an altitude of the forced aspiration gas cooking appliance based at least in part on the established location of the forced aspiration gas cooking appliance; and adjusting a speed of the air handler based at least in part on the determined altitude of the forced aspiration gas cooking appliance, wherein the location of the forced aspiration gas cooking appliance is a physical location of the forced aspiration gas cooking appliance.

14. The forced aspiration gas cooking appliance of claim 13, wherein the location characteristic of the network comprises at least one of an Internet Protocol address, a service set identifier and a media access control address.

15. The forced aspiration gas cooking appliance of claim 13, wherein the controller is configured for connecting to wireless network of a building in which the forced aspiration gas cooking appliance is located.

16. The forced aspiration gas cooking appliance of claim 13, wherein an Internet Protocol address is assigned to the forced aspiration gas cooking appliance when the controller connects to the network.

17. The forced aspiration gas cooking appliance of claim 16, wherein the controller is configured for establishing the location of the forced aspiration gas cooking appliance based at least in part on the Internet Protocol address of the forced aspiration gas cooking appliance.

18. The forced aspiration gas cooking appliance of claim 17, wherein the controller is configured for looking up a location associated with the Internet Protocol address of the forced aspiration gas cooking appliance in a database.

19. The forced aspiration gas cooking appliance of claim 13, wherein the controller is configured for looking up the altitude in a lookup table having a respective altitude associated with each location in the lookup table.

20. The forced aspiration gas cooking appliance of claim 13, further comprising a user interface, the controller in operative communication with the user interface, the controller further configured for receiving the location of the forced aspiration gas cooking appliance from the user interface if the location of the forced aspiration gas cooking appliance is not established.

* * * * *